US005313758A

United States Patent [19]

Willman et al.

[11] Patent Number: 5,313,758

[45] Date of Patent: May 24, 1994

[54] CONSTRUCTION BOARD AND ITS MANUFACTURING METHOD

[75] Inventors: Tarmo Willman, Kaarina; Esko Brunila, Pargas; Bjarne Pelto, Pargas; Lars Heselius, Pargas, all of Finland

[73] Assignee: Oy Partek AB, Pargas, Finland

[21] Appl. No.: 690,906

[22] PCT Filed: Dec. 15, 1989

[86] PCT No.: PCT/FI89/00235

§ 371 Date: Aug. 16, 1991

§ 102(e) Date: Aug. 16, 1991

[87] PCT Pub. No.: WO90/07040

PCT Pub. Date: Jun. 28, 1990

[30] Foreign Application Priority Data

Dec. 16, 1988 [FI] Finland ..... 885847

[51] Int. Cl.[5] ..... B32B 7/00; E04C 2/00

[52] U.S. Cl. ..... 52/415; 52/809; 52/745.19; 52/785; 156/250; 428/56; 428/74; 428/111

[58] Field of Search ..... 52/785, 408, 409, 420, 52/422, 424, 809, 415, 745.19; 156/250, 304.1; 428/53, 54, 111, 290, 55, 56, 74, 76

[56] References Cited

U.S. PATENT DOCUMENTS

| | | | |
|---|---|---|---|
| 2,869,598 | 1/1959 | Loetscher | 156/304.1 |
| 3,046,181 | 7/1962 | Mann et al. | 156/304.1 |
| 3,168,763 | 2/1965 | Gilbert | 52/785 |
| 3,230,995 | 1/1966 | Shannon | 156/250 |
| 3,686,061 | 8/1972 | Brown et al. | 156/304.1 |
| 4,093,762 | 6/1978 | Kiefer | 156/250 |
| 4,238,257 | 12/1980 | Remi et al. | 156/71 |
| 4,402,781 | 9/1983 | Couture et al. | 156/304.1 |
| 4,429,503 | 2/1984 | Holliday . | |
| 4,512,840 | 4/1985 | Marino | 156/304.1 |
| 4,618,387 | 10/1986 | Fisher et al. | 156/304.1 |
| 5,073,426 | 12/1991 | Blaauw | 428/56 |

FOREIGN PATENT DOCUMENTS

| | | |
|---|---|---|
| 368949 | 7/1974 | Sweden . |
| 385389 | 6/1976 | Sweden . |
| 441764 | 5/1984 | Sweden . |
| 8205778 | 5/1984 | Sweden . |
| 5642128 | 3/1984 | Switzerland . |
| 5661553 | 7/1987 | Switzerland . |

*Primary Examiner*—Carl D. Friedman
*Assistant Examiner*—Robert J. Canfield
*Attorney, Agent, or Firm*—Pennie & Edmonds

[57] ABSTRACT

A longitudinal laminate board of mineral wool and method of making the board are disclosed. The laminate board consists of adjacently disposed pieces at least some of which are shorter than the length of the board and whose fibre plane form an essentially right angle to the plane of the laminate board. The pieces are jointed within the laminate board.

13 Claims, 5 Drawing Sheets

CONSTRUCTION BOARD AND ITS MANUFACTURING METHOD

FIELD OF THE INVENTION

The invention relates to a construction board, in particular to a longitudinal laminate board of mineral wool, which is appropriate as a core of a sandwich element having a surface layer e.g. of sheet metal on each side. The laminate board consists of adjacently disposed rods, whose fibre plane forms essentially a right angle to that of the laminate board and at least a number of the rods being shorter than the laminate board.

The invention also relates to a method for manufacturing the laminate board, in which rods are cut out from a mineral wool sheet with a length different from the one of the laminate board, are rotated 90° about their longitudinal axes and are assembled into a laminate board.

BACKGROUND OF THE INVENTION

Laminate boards of this type are prior known and have been implemented for instance in naval industry as insulating walls of various spaces.

Sandwich elements of mineral wool have been utilized to some extent in naval industry. So far long supporting elements have not however, been available, neither as ceiling, floor nor wall elements.

Finished sandwich elements of mineral wool with the fibres oriented perpendicularly to the surface plane of the element would, owing to its resistance properties, be usable as supporting roof, floor and wall elements and would thus simplify building operations greatly.

SUMMARY OF THE INVENTION

The object of the present invention is thus to provide longitudinal laminate boards usable as a core of supporting sandwich elements for roof, floor and wall constructions as well as a method for manufacturing such laminate boards.

According to the invention, this object has been achieved by matching the opposite end surfaces of two aligned rods and connecting them and further by providing a method in which the rods are assembled with end surfaces facing into longitudinal rods, from which rods equalling the length of the laminate boards are cut off and connected laterally to form the laminate board.

Thus, the laminate board of the invention is longitudinal, it is made of binder fixed mineral wool and is appropriate for use as a core of a sandwich element, whereby it is combined with surface layers, of sheet metal for instance, on each side. The laminate core is formed of adjacent rods whose fibre plane is perpendicularly oriented to the plane of the laminate board and at least a number of the rods being shorter than the laminate board. According to the invention, the opposite end surfaces of two aligned rods are matched and interconnected. At least some of the rods being shorter than the laminate board, such rods consist of jointed rods. In this case it is essential that the end surface be connected so that the resistance of the laminate board is not deteriorated.

According to a preferred embodiment of the laminate board, the end surfaces are glued against each other. According to another embodiment, the end surfaces are pressed against each other forming border layer in which fibres from both surfaces are in contact with each other, engaging into each other.

According to a preferred embodiment, the matching end surfaces can be inclined so as not to form a right angle to the longitudinal axis of the rods. According to a further developed embodiment, the end surfaces form a right angle to the plane of the laminate board, being simultaneously and preferably tilted towards the longitudinal axis of the rods.

According to a further embodiment of the laminate board, the end surfaces form a so-called finger joint, the fingers forming projections and grooves parallel to the plane of the laminate board.

A laminate board according to the invention is produced in a known manner by cutting rods in a mineral wool board having a length different from the one of the laminate board, are rotated 90° about their longitudinal axes and are assembled to form a laminate board.

According to the invention, the rods are connected with end surfaces facing each other into longitudinal rods, in which rods having the length of the laminate board are cut off and interconnected laterally to form the laminate board. The connecting of the rods that are cut from the mineral wool board and rotated can take place in various manners. One preferred manner is to assemble cut off and rotated rods successively into a rod, from which rods of the desired length are cut and connected into a laminate board. The joints of the rods will then have a random distribution over the laminate board.

Another preferred embodiment is cutting several rods in the mineral wool board and turning them and subsequently phase displacing them axially. The phase displacement is essential considering that the joints must not be transversely aligned in the finished laminate board. By means of the phase displacement, a diffusion of the joints is provided. The phase displaced rods are then connected with end surfaces facing each other with the preceding flow of correspondingly cut and phase displaced rods forming a flow of longitudinal rods, in which a length equal to the one of the laminate board is cut in order to form the laminate board.

According to a preferred embodiment of the process, the rods are connected with a glue joint by applying glue to the end surfaces before connecting and fixing e.g. by drying subsequent to the forming of the laminate board. The glue application is appropriately performed before the phase displacement of the rod flow.

According to another preferred embodiment of the process, the end surfaces of the rods are face milled or prepared so as to match the surfaces well, before a possible glue application.

According to another preferred embodiment, the future lateral surfaces of the rods are face milled or prepared so that the rods will fit tightly to each other.

According to another embodiment, traces are made in the end faces of the rods, parallel to the plane of the laminate board or perpendicular to these, so as to provide a finger joint between the rods.

According to a further embodiment, the rods are pressed together during the connecting moment at a pressure exceeding 100 Pa, preferably 500 Pa.

The mineral wool mat used as starting material consists of a binder fixed mineral wool, which may be a rock wool or a glass wool, forming essentially plane parallel layers consisting of vitreous fibres more or less in disorder. By rotating the rods cut from the mat, rods having vertically oriented fibres are obtained, which is valuable for the resistance requirements of the laminate board when used as a construction element. This fibre orientation, allowing shearing forces to be transferred between the surface planes of the board, enables the use of very long boards, of the size order of 9–10 m, for construction purposes.

The manufacture of ribs or a laminate mat of that length by means of conventional methods is difficult and would require complicated transport mechanisms. With the process according to our invention, again, no complicated equipment is needed and the space requirement can also be considered moderate. By starting from shorter mineral wool webs when manufacturing the said long elements, i.e. laminate boards, and by cutting rods in these which together with other shorter rods are assembled into "longitudinal rods" and by cutting rods of the desired length in these long rods, i.e. of the length of the laminate board, a process has been achieved that is easy to accomplish and results in a laminate board of the desired length.

Due to the fact that the long rods composed of shorter rods are interconnected in an appropriate manner, such as compressing with interlocking fibres, glueing, engaging end surfaces like finger joint locking, etc. the laminate board has the resistance provided by the mineral wool together with the sandwich surface elements. On the other hand, the weakening influence of the joints has been eliminated.

BRIEF DESCRIPTION OF THE DRAWINGS

The various manufacturing steps are simple and can be varied in different ways. A preferred embodiment of the laminate board of the invention and its manufacture will be described below with reference to the enclosed figures, in which.

DETAILED DESCRIPTION OF THE INVENTION

Figure 1:
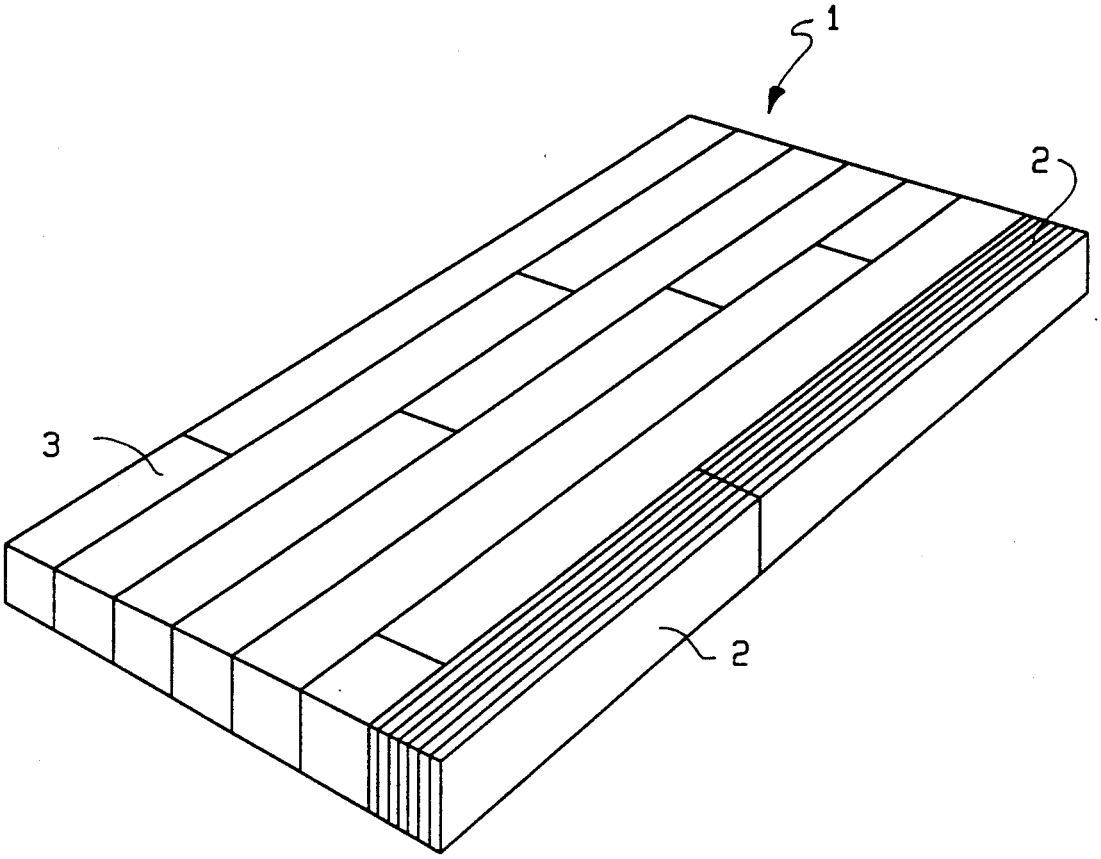
FIG. 1 shows a perspective of a laminate board.
Figure 2A:
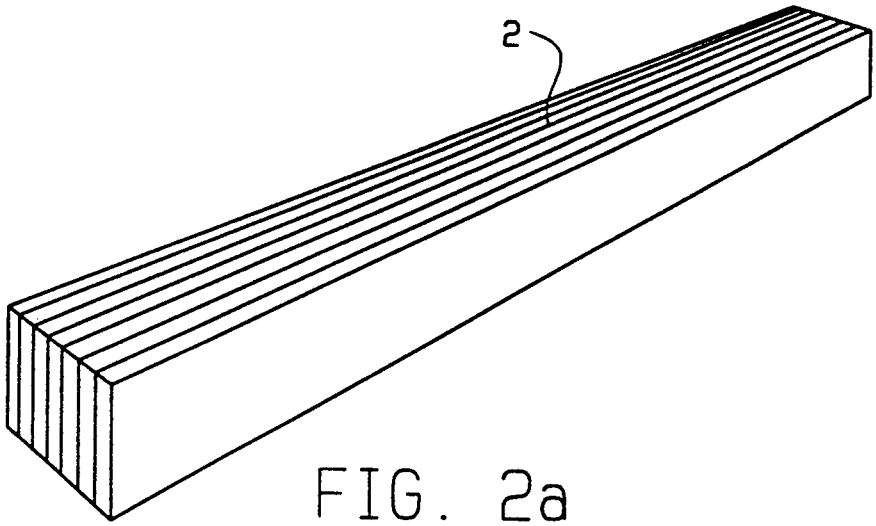
FIG. 2*a* shows an individual rod in perspective and on a larger scale.
Figure 2B:
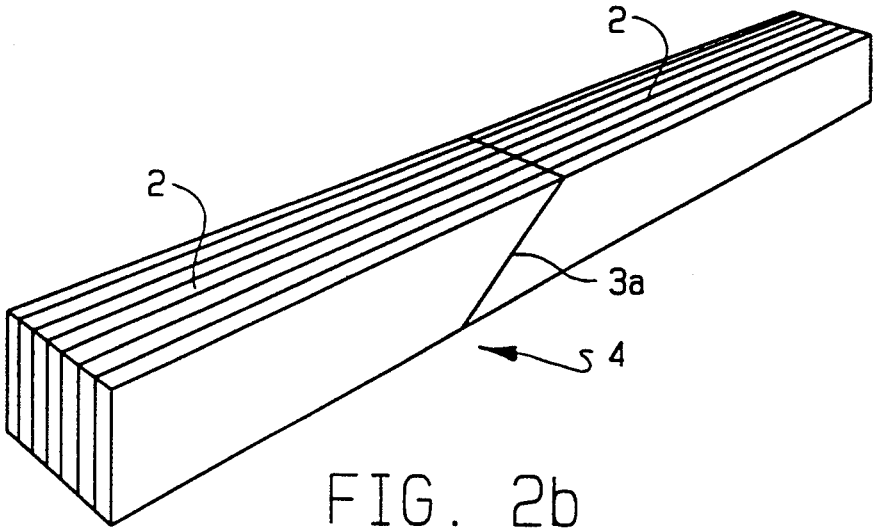
FIG. 2*b* shows an individual rod with a joint.
Figure 2C:
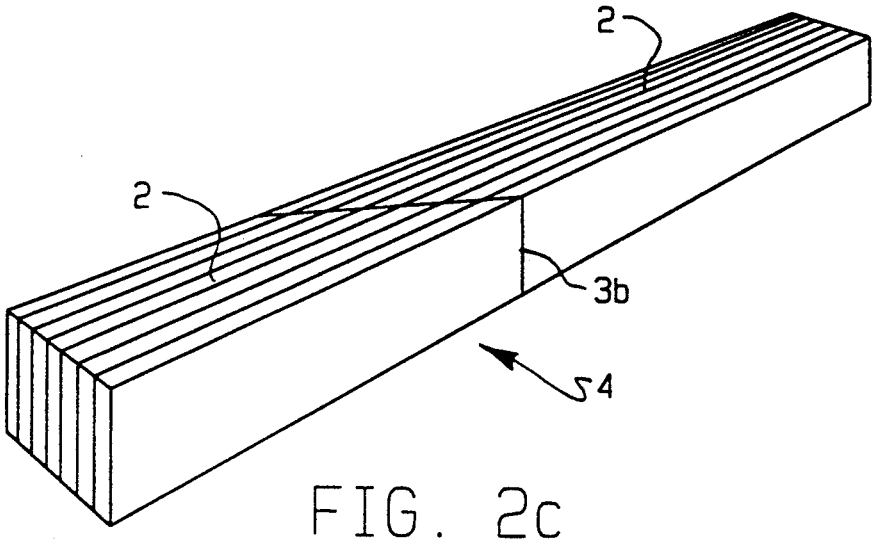
FIG. 2*c* shows an individual rod with a joint as an embodiment different from the preceding figure.

FIG. 1 shows a laminate board consisting of seven laminates 2, each consisting of two jointed rods. The joint is marked with 3. The FIGS. 2*a* show a jointless rod in which the fibre plane and the fibre orientation are indicated by the thin lines. The joint 3*a* of FIG. 2*b* is an inclined joint in which the end surfaces do not form a right angle to the axis of the rod, but form a right angle to the lateral plane of the rod. The joint 3*b* in FIG. 2*c* is also an inclined joint, in which the end surfaces do not either form a right angle to the axis of the joint, but again, form a right angle to the plane of the laminate board.

Figure 3:
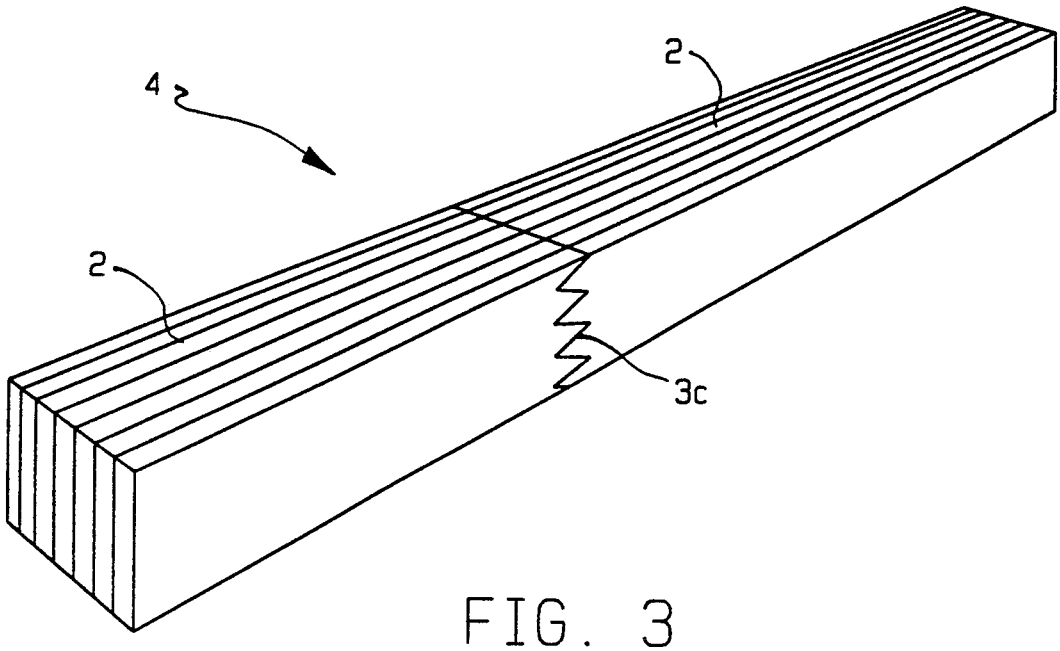
FIG. 3 shows a rod with a finger joint.
Figure 4:
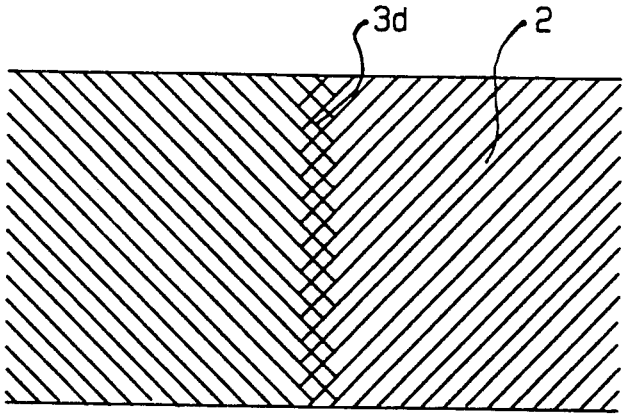
FIG. 4 shows a detail enlargement of a joint produced by compressing.

FIG. 3 shows a rod with a finger joint and FIG. 4 shows an enlargement of a joint produced by compressing the end surfaces. In FIGS. 3 and 4, the end surfaces are perpendicular to the axis of the rod. The joint 3*d* in FIG. 4 indicates how the fibres in each end surface penetrate into the opposite end surface.

Figure 5:
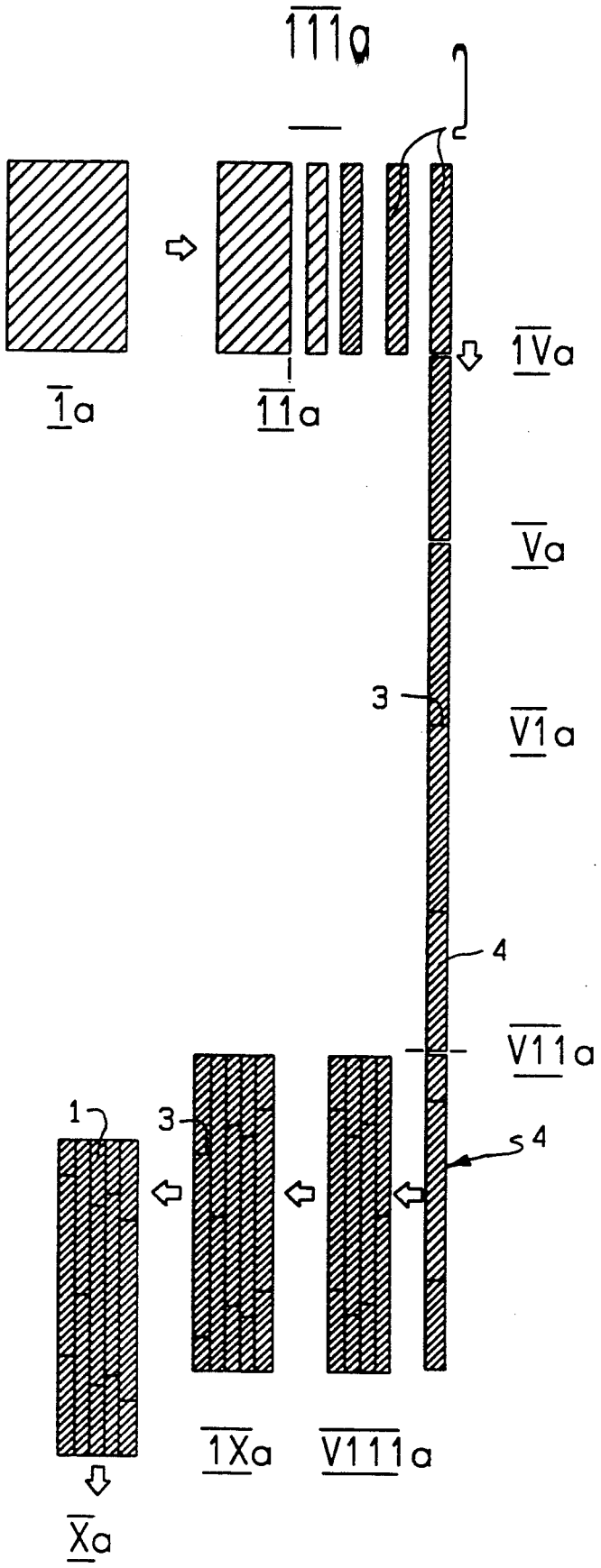
FIG. 5 shows an embodiment of the manufacture of a laminate board as a flow chart.

FIG. 5 shows an embodiment of the manufacture of a laminate board according to the invention.

Step 1*a* indicates the feeding of mineral wool boards produced by oscillating output, one at a time. Owing to the oscillating output, the fibre orientation is essentially perpendicular to the longitudinal axis of the web. In the step II*a* the board is cut into rods rotated 90° about their axes, thus yielding an essentially vertical fibre orientation in the formed sandwich element. A possible mechanical treatment of the end surfaces and a possible glue application is carried out just before or after the rotation, in step III*a*. The grinding of the future lateral surfaces of the rods is appropriately done in this step. Step IV*a* relates to the feeding of a rod in its longitudinal direction towards preceding rods, disposed with ends facing each other and being aligned. The first rod is in contact with an edge at the height of the point where the rods are assembled into a laminate board. Step V*a* indicates the connecting of the end surfaces of the rods, where a rod is pressed against the preceding rod and the end surfaces are fixed VI*a* against each other. In step VII*a* the front end of the longitudinal rod is cut off to a length equalling the one of the laminate board, after which the cut off rod is pushed laterally towards the collecting spot VIII*a* and from there further to the spot IX*a* where the laminate board is formed and compressed laterally. Synchronically with the feeding of surface layer, the finished laminate core is fed in the step X to the spot where the one surface layer and subsequently the second surface layer are to be applied. Finally the sandwich element is subject to a heat and pressure treatment for final drying and curing.

Figure 6:
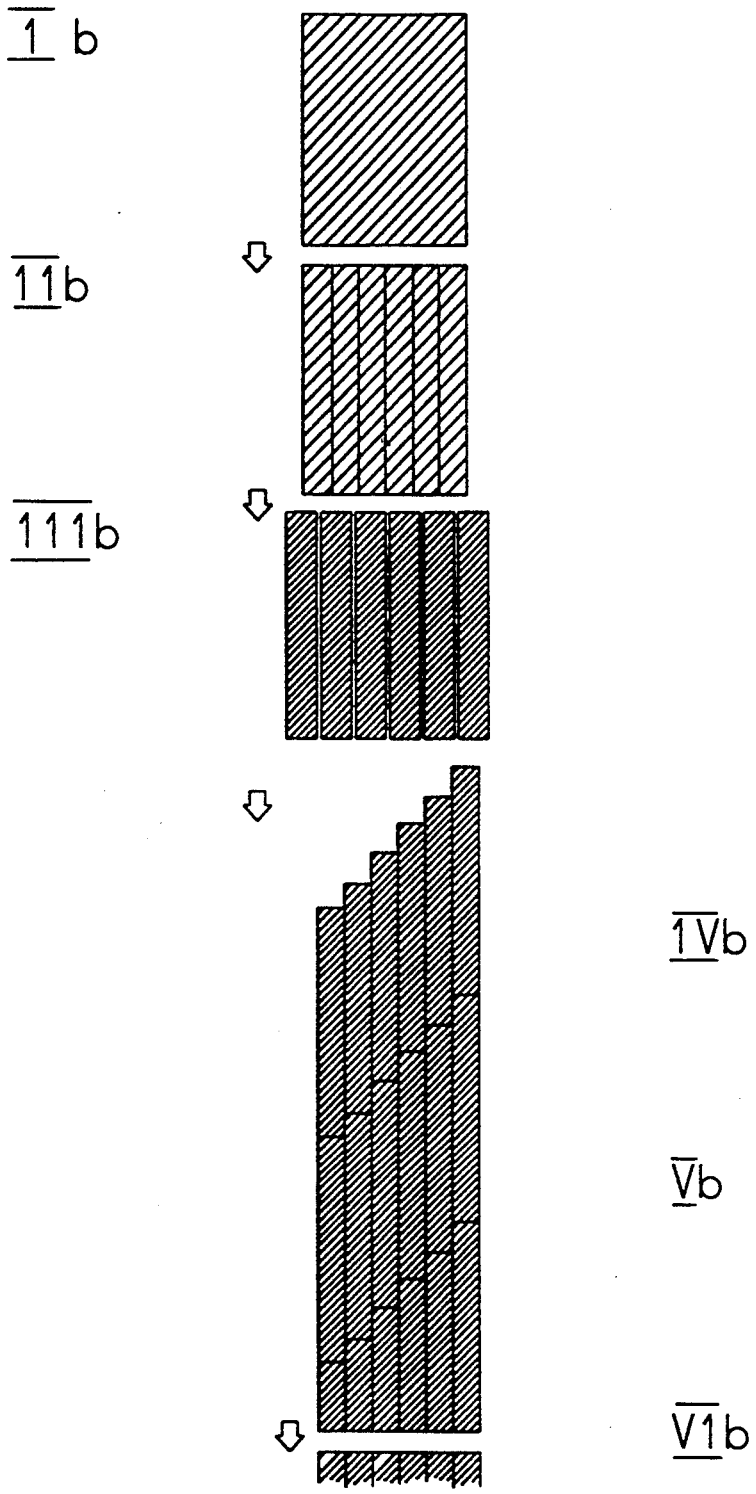
FIG. 6 shows another embodiment of the manufacture of a laminate board as a flow chart.

FIG. 6 shows another embodiment of the manufacture of a laminate board according to the invention. Steps IV*b*–VI*b* are in reality subsequently aligned with steps I*b*–III*b*. Because of lacking space on the paper, the figure has been split longitudinally.

Step I*b* indicates the input of material sheets one at a time. The manufacture is continuous in the longitudinal direction of the material sheet. The material sheet is fed and cut longitudinally in step II*b* into the desired number of rods. The future lateral surfaces of the rods are here subject to mechanical preparation, normally grinding. The cut material board is fed and the rods are rotated 90° about their longitudinal axis in step III.

Here the possible mechanical preparation of the ends of the rods and/or the glue application appropriately takes place. The rotated rods are pushed towards the preceding flow of rods in step IV*b* while the rods are being mutually phase diplaced in order to diffuse the joints longitudinally on the laminate board being prepared. When forwarding the rods a pressure is applied in the longitudinal direction of the board in order to press the ends of the rods against each other and to join them well. In step V*b* the laminate board consisting of longitudinal rods is cut to the desired length. In step VI*b* the laminate board having the final dimensions is fed to the spot where the surface layers are applied under lateral pressure, first the one and the other. The surface layers are usually of thin sheet metal, but can also be construction boards like minerite boards, moulded beton layers. Finally the sandwich element obtained is subject to drying and curing.

The processes of manufacturing the laminate board described above are merely two preferred embodiments. Besides these, there are alternative processes for manufacturing the board. Essential for them all is that the starting material is a mineral wool sheet of a length different from the one of the laminate board, normally an essentially shorter wool sheet, in which rods are cut, are rotated and connected longitudinally and assembled into a laminate board.

We claim:

1. A longitudinally extending lamella board (1) having opposed main surfaces and constructed of a plurality of side by side lamella (4) of binder fixed mineral wool fibers having a first fibre orientation and defining a core for a sandwich element having a surface layer of sheet material on both main surfaces, the lamellas (4) extending in the longitudinal direction of the board and the first fibre orientation of the lamellas forming essentially a right angle to the main surfaces of the board, the improvement wherein at least some of the lamellas (4) consist of lamella pieces (2) having a longitudinal axis extending parallel to the longitudinal direction of said laminate board (1) and having side surfaces and opposing end surfaces, said pieces being shorter than the lamella board (1) and interconnected at said opposing end surfaces, and said pieces extending between said main surfaces of said board without any separate support structure between said main surfaces.

2. A lamella board according to claim 1, wherein said end surfaces are glued to each other.

3. A lamella board according to claim 1 wherein said end surfaces are pressed to each other so as to form a border zone comprising fibres from both lamella pieces (2).

4. A lamella board according to claim 1, wherein said end surfaces form a non-right angle to the longitudinal axis of the lamella pieces (2).

5. A lamella board according to claim 1, wherein said end surfaces form a right angle to the main surface of the laminate board (1).

6. A lamella board according to claim 1, wherein said end surfaces form a finger joint.

7. A method for manufacturing a longitudinally extending lamella board (1) having opposed main surfaces and constructed of a plurality of side by side lamellas (4) of binder fixed mineral wool fibers having a first fibre orientation and defining a core for a sandwich element having a surface layer of sheet material on both main surfaces, the lamellas (4) extending in the longitudinal direction of the board and the first fibre orientation of the lamellas forming essentially a right angle to the main surface of the board, at least some of the lamellas (4) consisting of lamella pieces (2) having a longitudinal axis extending parallel to the longitudinal direction of said laminate board (1) and having side surfaces and opposing end surfaces, and said pieces being shorter than the lamella board (1) and interconnected at said opposing end surfaces and said lamella pieces being cut from a mineral wool mat of a different length than that of the lamella board and turned 90° around their longitudinal axis and assembled in end to end and side by side relation into said lamella board, said method comprising the steps of finishing the opposing end surfaces of successive lamella pieces (2) to match each other; interconnecting said pieces (2), in said end to end relation, into at least one long lamella; cutting said at least one long lamella into a plurality of lamellas (4) having lengths equalling the length of the lamella board (1); and assembling the cut lamellas (4) together in said side by side relation to form the lamella board.

8. The method according to claim 7, wherein the method includes the steps of connecting the cut and turned lamella pieces (2) one by one to form a long lamella with the opposed end surfaces engaging each other; and cutting all of said plurality of lamellas (4) from said long lamella one at a time into a length equal to the board length.

9. A method according to claim 7 wherein the method includes the steps of assembling the cut and turned lamella pieces (2) into successive groups of adjacent side by side pieces, displacing every individual lamella piece in each group longitudinally in regard to its adjacent pieces to form a displaced leading end surface and trailing end surface for each adjacent piece relative to each other piece in the group and connecting the so displaced leading end surfaces of the pieces of the group with the correspondingly displaced trailing end surfaces, of the pieces of the preceding group of lamella pieces to form a group of long lamellas, from which a board length is cut.

10. A method according to claim 7, wherein the end surfaces of the lamella pieces (2) are ground and shaped to another form than a straight cross cut.

11. A method according to claim 7, wherein the lamella pieces are connected by pressing the end surfaces together at a pressure exceeding 100 Pa, preferably 500 Pa.

12. A method according to claim 7, wherein glue is applied to the end surfaces before interconnecting.

13. A method according to claim 7, wherein the side surfaces of the lamellas are shaped for exact fitting in side by side relation.

* * * * *